US010612822B2

(12) United States Patent
Tao et al.

(10) Patent No.: US 10,612,822 B2
(45) Date of Patent: Apr. 7, 2020

(54) BENT PIPE WITH RETENTION MEMBER AND SEMICONDUCTOR REFRIGERATOR HAVING SAME

(71) Applicant: Qingdao Haier Joint Stock Co., Ltd., Qingdao (CN)

(72) Inventors: Haibo Tao, Qingdao (CN); Dong Yu, Qingdao (CN); Peng Li, Qingdao (CN); Jianru Liu, Qingdao (CN); Dingyuan Wang, Qingdao (CN); Chunyang Li, Qingdao (CN); Feifei Qi, Qingdao (CN); Lisheng Ji, Qingdao (CN)

(73) Assignee: QINGDAO HAIER JOINT STOCK CO., LTD, Qingdao (CN)

( * ) Notice: Subject to any disclaimer, the term of this patent is extended or adjusted under 35 U.S.C. 154(b) by 301 days.

(21) Appl. No.: 15/536,567

(22) PCT Filed: Sep. 28, 2015

(86) PCT No.: PCT/CN2015/090988

§ 371 (c)(1),
(2) Date: Jun. 15, 2017

(87) PCT Pub. No.: WO2016/095590

PCT Pub. Date: Jun. 23, 2016

(65) Prior Publication Data

US 2018/0023864 A1 Jan. 25, 2018

(30) Foreign Application Priority Data

Dec. 15, 2014 (CN) ..... 2014 1 0777923

(51) Int. Cl.
*F25B 21/02* (2006.01)
*F25D 23/00* (2006.01)
(Continued)

(52) U.S. Cl.
CPC ..... *F25B 21/02* (2013.01); *F25D 16/00* (2013.01); *F25D 19/00* (2013.01); *F25D 23/006* (2013.01);
(Continued)

(58) Field of Classification Search
CPC ..... F25B 21/02; F25B 2321/0251; F25B 2321/0252; F25D 11/00; F25D 16/00;
(Continued)

(56) References Cited

U.S. PATENT DOCUMENTS 1,946,496 A * 2/1934 Kleist ..... F25B 39/02 165/135
2,361,792 A * 10/1944 Philipp ..... F25D 11/025 312/291
(Continued)

FOREIGN PATENT DOCUMENTS

CN 1601215 A 3/2005
CN 201344679 Y 11/2009
(Continued)

OTHER PUBLICATIONS

International Search Report and Written Opinion of International Searching Authority for International Patent Application No. PCT/CN2015/090988 dated Dec. 31, 2015, with English translation, 16 pages.

*Primary Examiner* — Travis C Ruby
(74) *Attorney, Agent, or Firm* — Alston & Bird LLP

(57) ABSTRACT

A bent pipe and a semiconductor refrigerator having the same are provided. The bent pipe for a fluid to flow therein includes a plurality of bent portions; a plurality of connecting pipe sections, each connecting two adjacent bent portions; and a retention member, which is successively fixed at different locations along the length thereof to the bent portions on the same side of the bent pipe. At least some of
(Continued)

the pipe sections of the bent pipe can be kept in the bent shape by a retention member.

9 Claims, 7 Drawing Sheets

(51) Int. Cl.
*F28F 9/013* (2006.01)
*F28D 15/02* (2006.01)
*F25D 19/00* (2006.01)
*F25D 16/00* (2006.01)
*F25D 23/06* (2006.01)

(52) U.S. Cl.
CPC ..... *F25D 23/066* (2013.01); *F28D 15/0233* (2013.01); *F28F 9/0132* (2013.01); *F25B 2321/0252* (2013.01)

(58) Field of Classification Search
CPC ..... F25D 19/00; F25D 17/02; F25D 23/006; F25D 23/066; F25D 23/068; F28D 2015/0216; F28D 15/0233; F28D 15/0266; F28D 15/04; F28D 15/02; F28D 15/0275; F28F 9/0132
See application file for complete search history.

(56) References Cited

U.S. PATENT DOCUMENTS 2,492,648 A * 12/1949 McCloy ..... F25D 11/025 62/175
2,947,150 A * 8/1960 Roeder, Jr. ..... F25B 21/02 136/204
3,181,310 A * 5/1965 Ammons ..... F25D 11/006 62/432
4,258,554 A * 3/1981 Asselman ..... F25B 25/005 165/275
4,287,720 A * 9/1981 Barthel ..... F17C 3/08 62/45.1
4,354,359 A * 10/1982 Hall ..... F25D 19/003 62/299
4,619,317 A * 10/1986 Disselbeck ..... F28D 1/0472 165/162
4,951,481 A * 8/1990 Negishi ..... F25D 3/06 62/406
5,174,121 A * 12/1992 Miller ..... F25B 21/02 165/104.21
5,253,260 A * 10/1993 Palombo ..... F28D 15/0275 372/34
5,343,717 A * 9/1994 Ebbeson ..... F25B 17/00 62/481
5,349,821 A * 9/1994 Schrage ..... F24F 5/0042 62/3.2
5,398,510 A * 3/1995 Gilley ..... F25B 21/02 62/3.6
5,522,216 A * 6/1996 Park ..... F25B 21/02 62/3.6
5,544,487 A * 8/1996 Attey ..... F04D 13/0673 165/170
5,653,111 A * 8/1997 Attey ..... F04D 13/0673 165/170
6,014,968 A * 1/2000 Teoh ..... F24S 60/30 126/639
6,102,110 A * 8/2000 Julien ..... F28D 15/0275 165/104.33
6,272,867 B1 * 8/2001 Barrash ..... F25B 9/14 62/6
6,415,612 B1 * 7/2002 Pokharna ..... F25B 21/02 165/80.2
6,418,729 B1 * 7/2002 Dominguez-Alonso ..... F25B 21/02 62/3.2
6,517,221 B1 * 2/2003 Xie ..... F28D 15/0266 257/714
6,578,629 B1 * 6/2003 Trent ..... F24F 1/0059 165/104.13
6,658,857 B1 * 12/2003 George ..... F25B 21/04 165/121
6,672,373 B2 * 1/2004 Smyrnov ..... F28D 15/0266 165/104.26
6,776,220 B1 * 8/2004 Low ..... B64G 1/506 165/104.33
7,174,950 B2 * 2/2007 Jacque ..... B64G 1/506 165/104.26
7,213,408 B2 * 5/2007 Zhao ..... F25D 11/006 62/408
7,677,681 B2 * 3/2010 Cheon ..... F25D 23/066 220/62.17
8,991,194 B2 * 3/2015 Edwards ..... F25B 21/02 62/3.6
2001/0023762 A1 * 9/2001 Sagal ..... F28D 15/0233 165/185
2001/0039802 A1 * 11/2001 Barrash ..... F25B 9/14 62/6
2002/0023456 A1 * 2/2002 Sone ..... F25B 9/14 62/333
2002/0148234 A1 * 10/2002 Bell ..... F02G 1/043 62/3.3
2003/0029174 A1 * 2/2003 Lee ..... F24F 5/0042 62/3.6
2003/0084670 A1 * 5/2003 Kim ..... A45D 44/00 62/3.6
2005/0011220 A1 * 1/2005 Hallin ..... F25B 39/026 62/476
2005/0034477 A1 * 2/2005 Hu ..... B64D 13/00 62/435
2005/0257532 A1 * 11/2005 Ikeda ..... F25B 21/02 62/3.7
2006/0117761 A1 * 6/2006 Bormann ..... F25B 21/02 62/3.6
2006/0130514 A1 * 6/2006 Kim ..... F25B 39/02 62/446
2007/0017245 A1 * 1/2007 Song ..... F25B 39/02 62/443
2008/0047139 A1 * 2/2008 Hsu ..... B23P 15/26 29/890.03
2008/0163628 A1 * 7/2008 Lilke ..... F25B 21/02 62/3.6
2010/0073877 A1 * 3/2010 Yu ..... H01L 23/4093 361/697
2010/0107657 A1 * 5/2010 Vistakula ..... A41D 13/005 62/3.5
2010/0154452 A1 * 6/2010 McCann ..... A23B 4/066 62/247
2011/0203295 A1 * 8/2011 Hsu ..... F25B 21/02 62/3.2
2012/0047917 A1 * 3/2012 Rafalovich ..... F25D 11/025 62/66
2012/0192574 A1 * 8/2012 Ghoshal ..... F25B 21/02 62/3.2
2012/0304667 A1 * 12/2012 Shin ..... F25B 21/02 62/3.6
2013/0083485 A1 * 4/2013 Tong ..... H01L 23/427 361/700
2013/0107547 A1 * 5/2013 Cheng ..... H01L 23/427 362/373
2013/0291559 A1 * 11/2013 June ..... F25B 21/00 62/3.2
2013/0291563 A1 * 11/2013 Edwards ..... F25B 21/02 62/3.3
2013/0291564 A1 11/2013 Ghoshal et al.
2014/0260332 A1 * 9/2014 Wu ..... F25B 1/00 62/3.6
2014/0290929 A1 * 10/2014 Opila ..... H01L 23/427 165/287
2014/0293541 A1 * 10/2014 Opila ..... F28D 15/02 361/697

(56) References Cited

U.S. PATENT DOCUMENTS

FOREIGN PATENT DOCUMENTS

| | | | |
|---|---|---|---|
| CN | 202002404 | U | 10/2011 |
| CN | 202501675 | U | 10/2012 |
| CN | 202792716 | U | 3/2013 |
| CN | 203810826 | U | 9/2014 |
| CN | 104180576 | A | 12/2014 |
| CN | 104613804 | A | 5/2015 |
| DE | 202011108050 | U1 | 12/2011 |
| DE | 102012022023 | A1 | 5/2014 |
| JP | 2002139298 | A | 5/2002 |
| KR | 20100013925 | A | 2/2010 |
| KR | 20100108754 | A | 10/2010 |

* cited by examiner

BENT PIPE WITH RETENTION MEMBER AND SEMICONDUCTOR REFRIGERATOR HAVING SAME

CROSS-REFERENCE TO RELATED APPLICATIONS

This application is a national phase entry of International Application No. PCT/CN2015/090988, filed Sep. 28, 2015, which claims priority to Chinese Application No. 201410777923.8, filed Dec. 15, 2014, the entire contents of which are incorporated herein by reference.

TECHNICAL FIELD

The present invention relates to a refrigeration apparatus and, more particularly, to a bent pipe and a semiconductor refrigerator having the bent pipe.

BACKGROUND OF THE INVENTION

A bent pipe may be subjected to a relatively large external force during manufacture, transportation and installation, resulting in deformation of the bent portions of the pipe, thereby changing the bending angle of the entire pipe. However, this is very unfavourable and even totally unacceptable for applications where the bent pipe needs to meet high requirements. For example, in a semiconductor refrigerator, a heat exchanging device composed of a refrigerant case and a bent pipe is often used to transfer heat from the hot end of a semiconductor cooler to the housing or to transfer cold from the cold end of the semiconductor cooler to a storage compartment of a liner. As the refrigerant case and the bent pipe are filled with a refrigerant and the refrigerant is allowed to flow therein and undergo phase-change heat exchange, so that the cold from the cold end of the semiconductor cooler is transferred to the liner of the refrigerator, or the heat from hot end of the semiconductor cooler is transferred to the housing of the refrigerator, it has to be ensured that the refrigerant flows in the bent pipe and is effectively evaporated or condensed, which imposes high requirements for the bent pipe.

SUMMARY OF THE INVENTION

An object of a first aspect of the present invention is to overcome at least one defect of the existing bent pipes and is to provide a bent pipe which keeps the bending angle of the bent portion thereof constant.

Another object of the first aspect of the present invention is to increase the rigidity of the bent pipe.

An object of a second aspect of the present invention is to provide a semiconductor refrigerator having the aforementioned bent pipe.

According to the first aspect of the present invention, there is provided a bent pipe for a fluid to flow therein. The bent pipe comprises a plurality of bent portions; a plurality of connecting pipe sections, each connecting two adjacent bent portions; and a retention member, which is successively fixed at different locations along the length thereof to the bent portions on the same side of the bent pipe.

Optionally, each of the connecting pipe sections is a straight pipe.

Optionally, one end of the bent pipe is an open end and the other end is a closed end.

Optionally, the bent pipe further comprises: a further retention member, which is successively fixed at different locations along the length thereof to the bent portions on the other side of the bent pipe.

Optionally, the retention member and the further retention member are arranged parallel to each other.

Optionally, the retention member is a retention slat or a drawstring.

Optionally, the retention member has an elastic modulus of 190 Gpa or more.

Optionally, fixing the retention member successively at different locations along the length thereof to the bent portions on the same side of the bent pipe is implemented by welding the retention member successively at different locations along the length thereof to a top hump of each of the bent portions on the same side of the bent pipe.

Optionally, pipe walls of the bent pipe that are in contact with the retention member are all fixed to the retention member.

According to the second aspect of the present invention, there is provided a semiconductor refrigerator. The semiconductor refrigerator comprises a liner, a semiconductor cooler, a heat exchanging device and a housing, wherein the heat exchanging device is provided with a heat exchanging part which allows a refrigerant to flow therein and undergo phase-change heat exchange and a plurality of refrigerant pipelines with one end connecting to an inner cavity or pipeline of the heat exchanging part for transferring heat from the hot end of the semiconductor cooler to the housing, or transferring cold from the cold end of the semiconductor cooler to a storage compartment of the liner. In particular, each of the refrigerant pipelines is any of the above bent pipes.

Since the bent pipe and the semiconductor refrigerator of the present invention have a retention member, at least some of the pipe sections of the bent pipe can be kept in the bent shape such that the bending angle of the bent pipe is kept constant, so that the refrigerant in the semiconductor refrigerator can reliably flow in the bent pipe and can be effectively evaporated or condensed.

Further, due to the high elastic modulus of the retention member in the bent pipe and the semiconductor refrigerator of this proposal, the rigidity of the bent pipe is significantly improved to ensure that the bent portions thereof are not deformed during the manufacture, transportation and installation of the bent pipe.

The foregoing and other objects, advantages and features of the present invention will become more apparent to those skilled in the art from the following detailed description of specific embodiments of the invention taken in conjunction with the accompanying drawings.

BRIEF DESCRIPTION OF THE DRAWINGS

Some specific embodiments of the present invention will be described in detail by way of example only rather than by way of limitation with reference to the accompanying drawings. The same reference numerals in the accompanying drawings denote the same or similar components or parts. It should be understood by those skilled in the art that these drawings are not necessarily to scale. In the accompanying drawings.

DETAILED DESCRIPTION OF THE INVENTION

Figure 1:
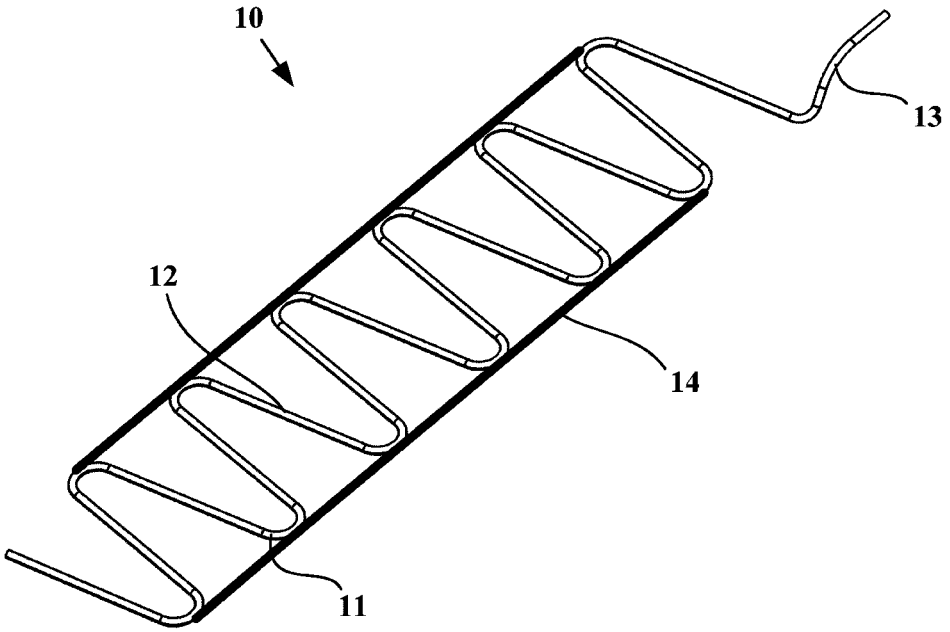
FIG. 1 is a schematic structural view of a bent pipe according to one embodiment of the present invention.

The embodiments of the present invention will be described below in detail, and the examples of embodiments are shown in the drawings. The embodiments described below with reference to the drawings are exemplary and are merely used to explain the present invention, and cannot be interpreted as a restriction on the present invention. In the description of the present invention, the azimuth or positional relationship indicated by the terms "upper", "lower", "front", "rear" and the like is based on the azimuth or positional relationship shown in the drawings only for the purpose of facilitating the description of the invention, rather than requiring that the present invention must be constructed and operated in the particular azimuth, and therefore cannot be construed as limiting the present invention.

Figure 2:
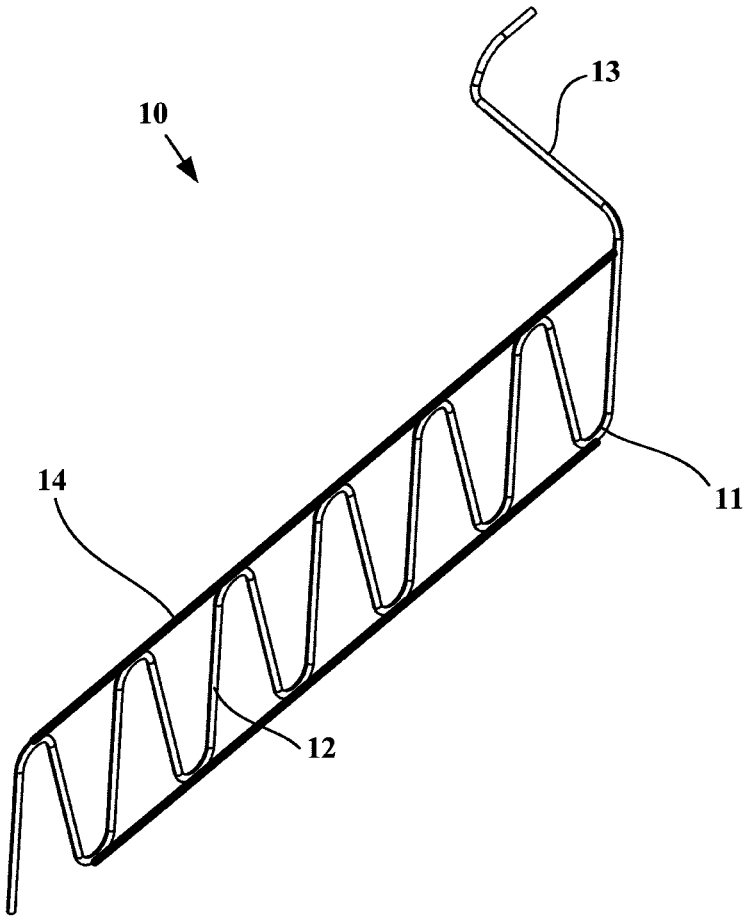
FIG. 2 is a schematic structural view of a bent pipe according to one embodiment of the present invention.

FIG. 1 is a schematic structural view of a bent pipe 10 according to one embodiment of the present invention. As shown in FIG. 1, and with reference to FIG. 2, an embodiment of the present invention provides a bent pipe 10 for a fluid to flow therein, which bent pipe 10 is particularly suitable for use in a heat exchanging device in a semiconductor refrigerator. Specifically, the bent pipe 10 may comprise a first pipe section having a plurality of bent portions 11 and a plurality of connecting pipe sections 12, and the plurality of connecting pipe sections 12 of the first pipe section are connected to each two adjacent bent portions 11, respectively. In some embodiments of the present invention, the bent pipe 10 may include a second pipe section 13 disposed at one end of the first pipe section, and the bent pipe 10 may have only the first pipe section.

In order to keep at least some of the pipe sections of the bent pipe 10 in a bent shape so that the bending angle of the bent pipe 10 is kept constant, the bent pipe 10 in the embodiment of the present invention further comprises retention member 14, which is successively fixed at different locations along the length thereof, to the bent portions 11 on the same side of the bent pipe 10 such that the bending angle of the bent pipe 10 is kept constant, so that the refrigerant in the semiconductor refrigerator can reliably flow in the bent pipe 10 and can be effectively evaporated or condensed.

In some embodiments of the present invention, the bent pipe 10 may also include a further retention member 14, which is successively fixed at different locations along the length thereof to the bent portions 11 on the other side of the bent pipe 10. Each of the connecting pipe sections 12 is a straight pipe. The axes of the connecting pipe sections 12 and the bent portions 11 may be in the same plane. The plurality of connecting pipe sections 12 may be arranged at intervals along the lengthwise direction of the retention member 14 and are obliquely arranged at an angle of 10° to 80° with respect to the lengthwise direction of the retention member 14, and each of the bent portions 11 is preferably arranged to be "C"-shaped or arc-shaped, so that the first pipe section of the bent pipe 10 generally exhibits an inclined "Z"-shaped structure. Fixing the retention member 14 successively at different locations along the length thereof to the bent portions 11 on the same side of the bent pipe 10 is implemented by welding the retention member 14 successively at different locations along the length thereof to a top hump of each of the bent portions 11 on the same side of the bent pipe 10.

The top hump of each bent portion 11 may also be referred to as the outer apex of each bent portion 11. Specifically, the two retention members 14 may be arranged parallel to each other, namely the retention member 14 and the further retention member 14 may be arranged parallel to each other, and the two retention members 14 are respectively fixed on two sides of the first pipe section of the bent pipe 10, and each of the retention member 14 is successively welded at different locations along the length thereof to the top hump of each of the bent portions 11 on the respective side of the first pipe section of the bent pipe 10. In some further embodiments of the present invention, the pipe walls of the bent pipe 10 that are in contact with the retention member 14 may all be fixed to the retention member 14, that is to say, except that the bent portions 11 of the bent pipe 10 are fixed to the retention member 14, if the pipe walls of the other pipe sections of the bent pipe 10 are in contact with the retention member 14, the pipe walls at this place may also be fixed to the retention member 14 by a fixing process such as welding.

In some embodiments of the present invention, each bent pipe 10 may be selected from a copper tube, a stainless steel tube, an aluminum tube, etc., preferably a copper tube. The retention member 14 has an elastic modulus of 190 GPa or more to ensure the rigidity of the retention member 14, so as to keep at least some of the pipe sections of the bent pipe 10 in a bent shape. Preferably, the retention member 14 may be made of carbon steel or alloy steel. The retention member 14 may be a retention slat or drawstring, such as a steel strip, a steel tube or a steel wire rope.

In some embodiments of the present invention, one end of the bent pipe 10 is an open end and the other end is a closed end, so as to be applied to a heat exchanging device in a semiconductor refrigerator.

Figure 3:
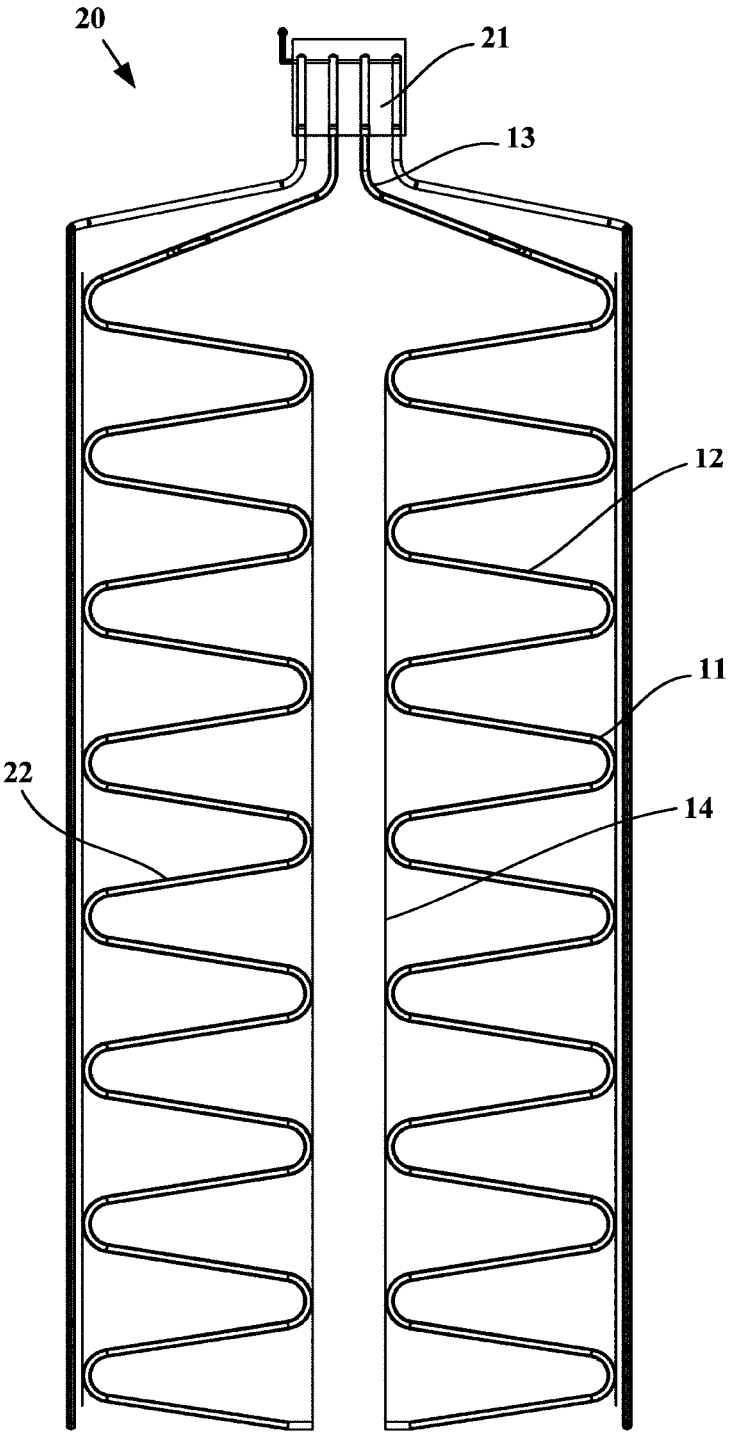
FIG. 3 is a schematic rear view of a heat exchanging device according to one embodiment of the present invention.
Figure 4:
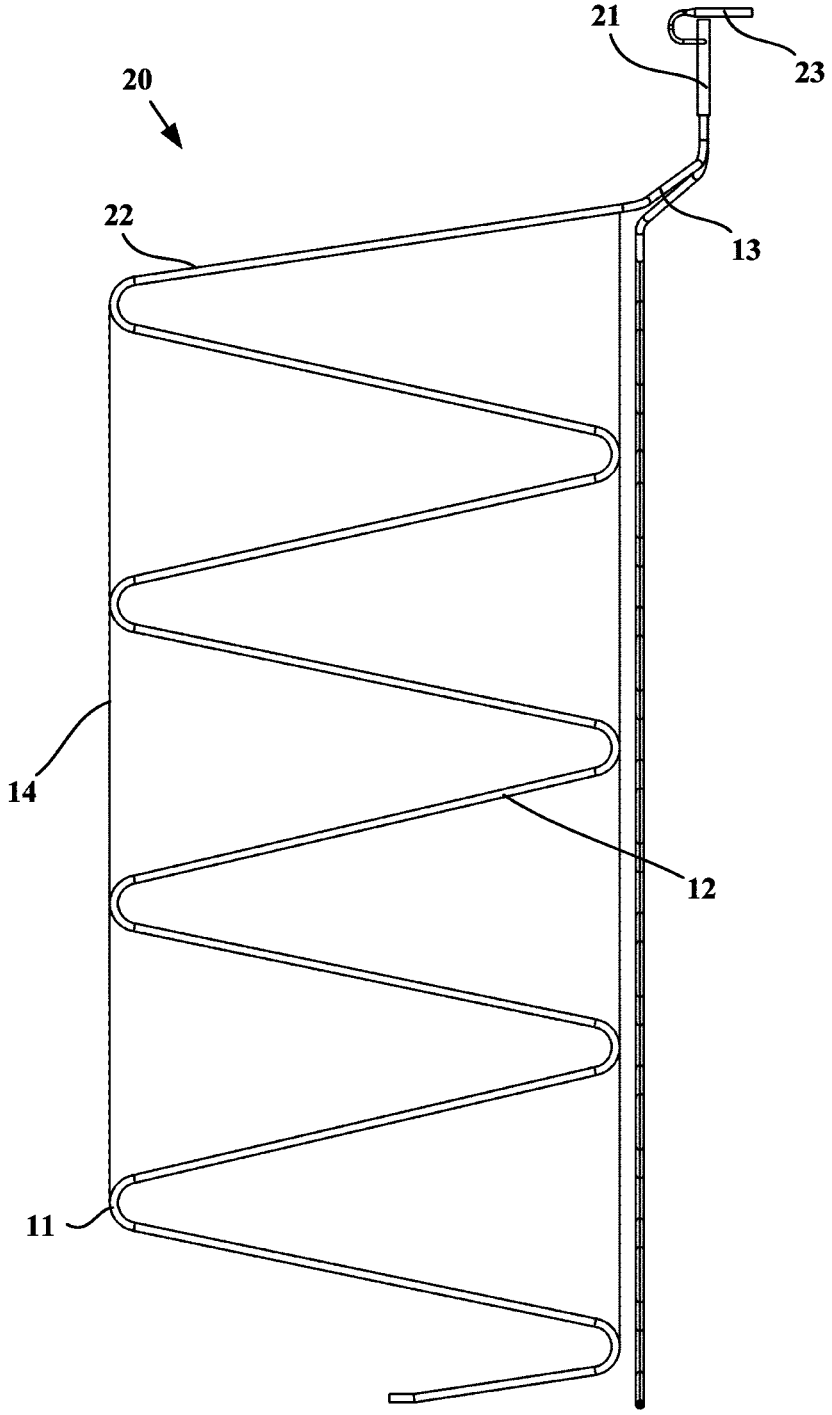
FIG. 4 is a schematic right view of a heat exchanging device according to one embodiment of the present invention.

As shown in FIGS. 3 and 4, an embodiment of the present invention further provides a heat exchanging device for use in an semiconductor refrigerator. The heat exchanging device may be used to transfer the cold from the cold end of the semiconductor cooler to the storage compartment of the liner 100, which may also be referred to as a cold end heat exchanging device 20, which may include a cold end heat exchanging part 21 and a plurality of refrigerant pipelines 22. Specifically, the cold end heat exchanging part 21 defines an inner cavity or pipeline for containing a gas-phase and liquid-phase co-existing refrigerant and is configured to allow the refrigerant to flow therein and undergo phase-change heat exchange. The plurality of refrigerant pipelines 22 are configured to allow the refrigerant to flow therein and undergo phase-change heat exchange. Each of the refrigerant pipelines 22 is provided with: an evaporation section which is downwardly bent and extends in a vertical plane and has a closed tail end, and a connection section which is upwardly bent and extends from a starting end of the evaporation section and communicates to the inner cavity or pipeline. That is to say, the first end of each refrigerant pipeline 22 forming the open end communicates to the lower portion of the inner cavity or pipeline, and each refrigerant pipeline 22 obliquely downwardly bent and extends from the first end thereof and terminates at the second end forming the closed end. Each of the refrigerant pipelines 22 may be selected as the bent pipe 10 in any of the above embodiments, the first pipe section of the bent pipe 10 is the evaporation section of each of the refrigerant pipeline 22, and the second pipe section 13 of the bent pipe 10 is the connection section of each of the refrigerant pipelines 22. In some embodiments of the present invention, the refrigerant poured into the cold end heat exchanging part 21 and the refrigerant pipelines 22 may be carbon dioxide or other refrigeration medium, and the pouring amount of the refrigerant may be measured by a test.

In the embodiment of the present invention, the cold end heat exchanging part 21 of the cold end heat exchanging device 20 may be a heat exchange copper block in which four stepped blind holes extending in the vertical direction and a horizontal tube hole in communication with the upper portion of each of the step blind holes are provided to form a pipeline inside the cold end heat exchanging part 21. The upper end of each of the refrigerant pipelines 22 can be inserted into the corresponding stepped blind hole. The cold end heat exchanging device 20 further comprises a refrigerant pouring tube 23 having one end being in communication with the corresponding horizontal tube bore and the other end being operatively open the normally closed end to receive the refrigerant poured from the outside, so as to pour the refrigerant into each of the refrigerant pipelines 22. In some alternative embodiments of the present invention, the cold end heat exchanging part 21 of the cold end heat exchanging device 20 may be a cold end heat exchange box defining an inner cavity or pipeline for containing a gas-phase and liquid-phase co-existing refrigerant and is configured to allow the refrigerant to undergo phase-change heat exchange. The connection section of each of the refrigerant pipelines 22 is in communication with the lower portion of the inner cavity. The cold end heat exchanging device 20 may be further provided with a three-way device for pouring the refrigerant.

The cold end heat exchanging part 21 of the cold end heat exchanging device 20 may be disposed between the rear wall of the liner 100 and the back of a housing 300 when the cold end heat exchanging device 20 of the embodiment of the present invention is applied to the semiconductor refrigerator. The rear surface of the cold end heat exchanging part 21 is abutted against the cold end of the semiconductor cooler, and the evaporation section of each of the refrigerant pipelines 22 is abutted against the outer surface of the liner 100. In an embodiment of the present invention, the number of the plurality of refrigerant pipelines 22 may be 4, wherein the evaporation sections of two of the refrigerant pipelines 22 have a projected length on a horizontal plane that is smaller than ½ of the width of the rear wall of the liner 100 of the semiconductor refrigerator and greater than ¼ of the width of the rear wall of the liner 100, so that the evaporation sections of the two refrigerant pipelines 22 are abutted against and thermally connected to the left and right half portions of the outer surface of the rear wall of the liner 100, respectively. The evaporation sections of the other two refrigerant pipelines 22 have a projected length on the horizontal plane that is smaller than the width of the side wall of the liner 100 of the semiconductor refrigerator and greater than ½ of the width of the side wall of the liner 100, so that the evaporation sections of the two refrigerant pipelines 22 are abutted against and thermally connected to the outer surfaces of the two side walls of the liner 100, respectively.

The working process of the semiconductor refrigerator having the aforementioned cold end heat exchanging device 20 is as follows: when the semiconductor cooler is powered on and operates, the temperature of the cold end decreases, the temperature of the cold end heat exchanging part 21 correspondingly decreases due to the conduction, and the gaseous refrigerant therein undergoes phase change to be condensed when subjected to cold, to change into the liquid refrigerant at a low temperature; and the liquid refrigerant flows down due to gravity along the cavity of the refrigerant pipeline 22, and the condensed flown-down refrigerant is heated, undergoes phase change and is evaporated in the refrigerant pipeline 22 since it absorbs heat from the interior of the refrigerator to change into a gaseous state. The gaseous vapour will rise under the driving of the pressure of a heat source, and the gaseous refrigerant will rise to the cold end heat exchanging part 21 to continue to condense, thereby repeating the refrigeration, resulting in the lowered temperature of the storage compartment so that the cooling is achieved.

Figure 5:
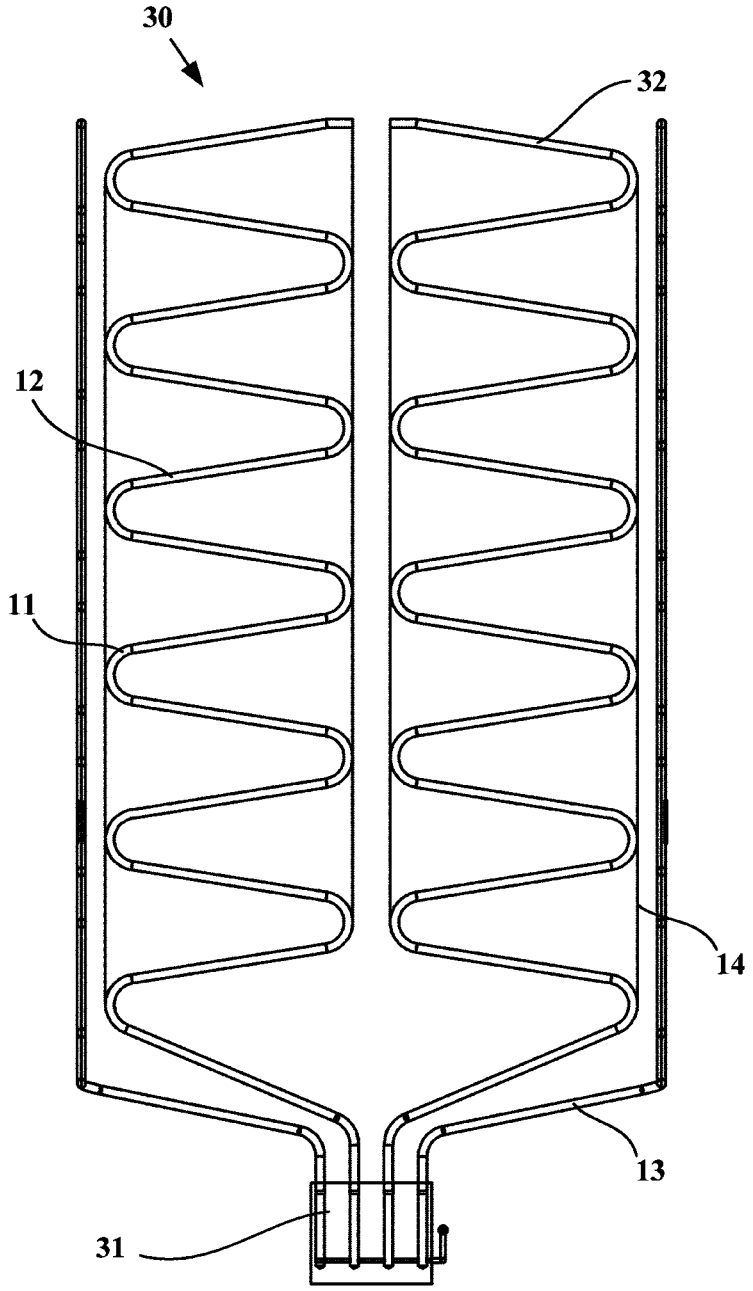
FIG. 5 is a schematic front view of a heat exchanging device according to one embodiment of the present invention.
Figure 6:
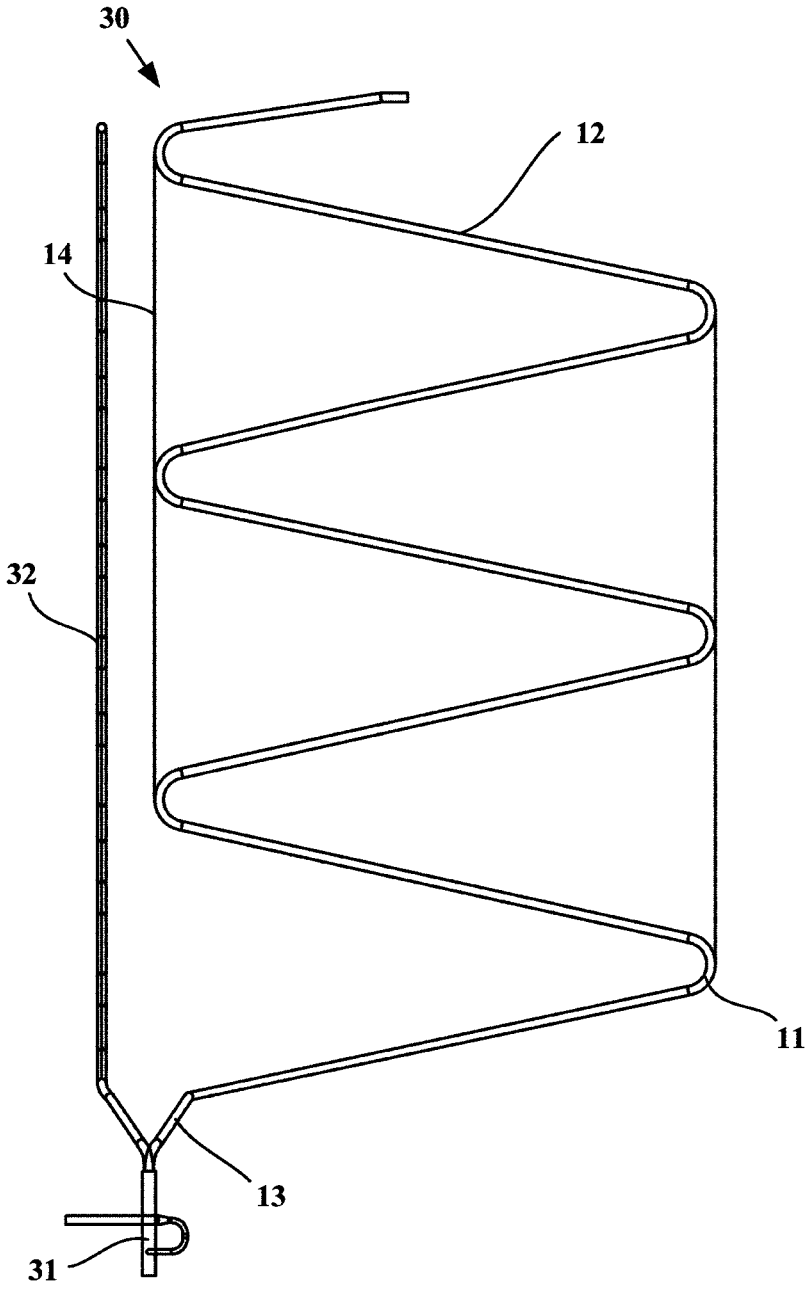
FIG. 6 is a schematic left view of a heat exchanging device according to one embodiment of the present invention.

As shown in FIGS. 5 and 6, an embodiment of the present invention further provides a heat exchanging device for use in an semiconductor refrigerator. The heat exchanging device may be used to transfer the heat from the hot end of the semiconductor cooler to the housing 300 of the refrigerator, which may also be referred to as a hot end heat exchanging device 30, which may include a hot end heat exchanging part 31 and a plurality of refrigerant pipelines 32. Specifically, the hot end heat exchanging part 31 defines an inner cavity or pipeline for containing a gas-phase and liquid-phase co-existing refrigerant and is configured to allow the refrigerant to flow therein and undergo phase-change heat exchange. The plurality of refrigerant pipelines 32 are configured to allow the refrigerant to flow therein and undergo phase-change heat exchange. Each of the refrigerant pipelines 32 is provided with: a condensation section which is upwardly bent and extends in a vertical plane and has a closed tail end, and a connection section which is downwardly bent and extends from a starting end of the condensation section and communicates to the inner cavity or pipeline. That is to say, the first end of each refrigerant pipeline 32 forming the open end communicates to the upper portion of the inner cavity or pipeline, and each refrigerant pipeline 32 obliquely upwardly bent and extends from the first end thereof and terminates at the second end forming the closed end. Each of the refrigerant pipelines 32 may be selected as the bent pipe 10 in any of the above embodiments, the first pipe section of the bent pipe 10 is the condensation section of each of the refrigerant pipeline 32, and the second pipe section 13 of the bent pipe 10 is the connection section of each of the refrigerant pipelines 32. In some embodiments of the present invention, the refrigerant poured into the hot end heat exchanging part 31 and the refrigerant pipelines 32 may be water or other refrigeration medium, and the pouring amount of the refrigerant may be measured by a test.

In the embodiment of the present invention, the hot end heat exchanging part 31 of the hot end heat exchanging device 30 may be a heat exchange copper block in which four stepped blind holes extending in the vertical direction and a horizontal tube hole in communication with the upper portion of each of the step blind holes are provided to form a pipeline inside the hot end heat exchanging part 31. The lower end of each of the refrigerant pipelines 32 can be inserted into the corresponding stepped blind hole. In some alternative embodiments of the present invention, the hot end heat exchanging part 31 of the hot end heat exchanging device 30 may also be a hot end heat exchange box defining an inner cavity or pipeline for containing a gas-phase and liquid-phase co-existing refrigerant and is configured to allow the refrigerant to undergo phase-change heat exchange.

The hot end heat exchanging part 31 of the hot end heat exchanging device 30 may be disposed between the rear wall of the liner 100 and the back of a housing 300 when the hot end heat exchanging device 30 of the embodiment of the present invention is applied to the semiconductor refrigerator. The rear surface of the hot end heat exchanging part 31 is thermally connected to the hot end of the semiconductor cooler, and the condensation section of each of the refrigerant pipelines 32 is abutted against the inner surface of the housing 300. In an embodiment of the present invention, the number of the plurality of refrigerant pipelines 32 may be 4, wherein the condensation sections of two of the refrigerant pipelines 32 have a projected length on a horizontal plane that is smaller than ½ of the width of the back of the housing 300 of the semiconductor refrigerator and greater than ¼ of the width of the back of the housing 300, so that the condensation sections of the two refrigerant pipelines 32 are abutted against and thermally connected to the left and right half portions of the inner surface of the back of the housing 300, respectively. The condensation sections of the other two refrigerant pipelines 32 have a projected length on the horizontal plane that is smaller than the width of the side wall of the housing 300 of the semiconductor refrigerator and greater than ½ of the width of the side wall of the housing 300, so that the condensation sections of the two refrigerant pipelines 32 are abutted against and thermally connected to the inner surfaces of the two side walls of the housing 300, respectively.

The working process of the semiconductor refrigerator having the aforementioned hot end heat exchanging device 30 is as follows: when the semiconductor cooler is operated and operates, heat is emitted from the hot end, the temperature of the hot end heat exchanging part 31 thermally connected thereto correspondingly rises up, and the liquid refrigerant in the hot end heat exchanging part 31 is evaporated when being heated to change into the gaseous state; the gaseous refrigerant will rise up along the refrigerant pipeline 32 under the pressure of the heat source and transfers the heat to the surrounding environment through the housing 300, and the refrigerant is condensed to release heat to re-phase change into the liquid state, is automatically returned to the cavity of the hot end heat exchanging part 31 by gravity, and again absorbs the heat emitted from the hot end to evaporate same, thus performing repeated phase-change heat dissipation, and effectively reducing the temperature of the hot end.

An embodiment of the present invention further provides a semiconductor refrigerator. The semiconductor refrigerator may comprise: a liner 100, a housing 300, a semiconductor cooler, a heat exchanging device in any of the above embodiments, and a door, etc. The storage compartment is defined in the liner 100, the back of the housing 300 defines an installation space with the rear wall of the liner 100, and the semiconductor cooler may be provided between the back of the housing 300 and the rear wall of the liner 100, i.e. in the installation space defined by the back of the housing 300 and the rear wall of the liner 100.

Figure 7:
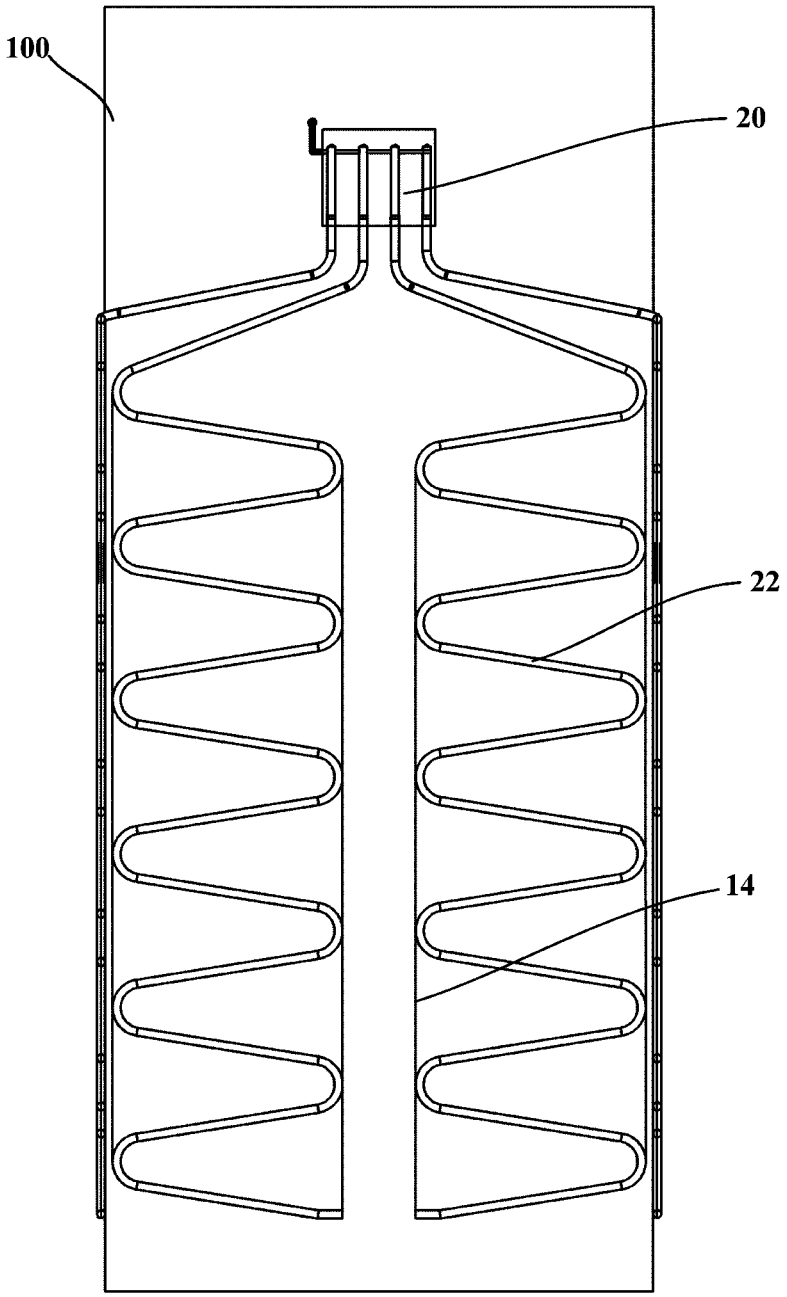
FIG. 7 is a schematic rear view of a partial structure of a semiconductor refrigerator according to one embodiment of the present invention.

As shown in FIG. 7, the heat exchanging device may be a cold end heat exchanging device 20, and the refrigerant pipeline 22 of the cold end heat exchanging device 20 is a bent pipe 10 in any of the aforementioned embodiments, which may be mounted in such a way that the rear surface of the cold end heat exchanging part 21 thereof is abutted against and thermally connected to a cold end of the semiconductor cooler, and the evaporation section of each of the refrigerant pipelines 22 is abutted against the outer surface of the inner 100 for transferring the cold from the cold end to the storage compartment.

Figure 8:
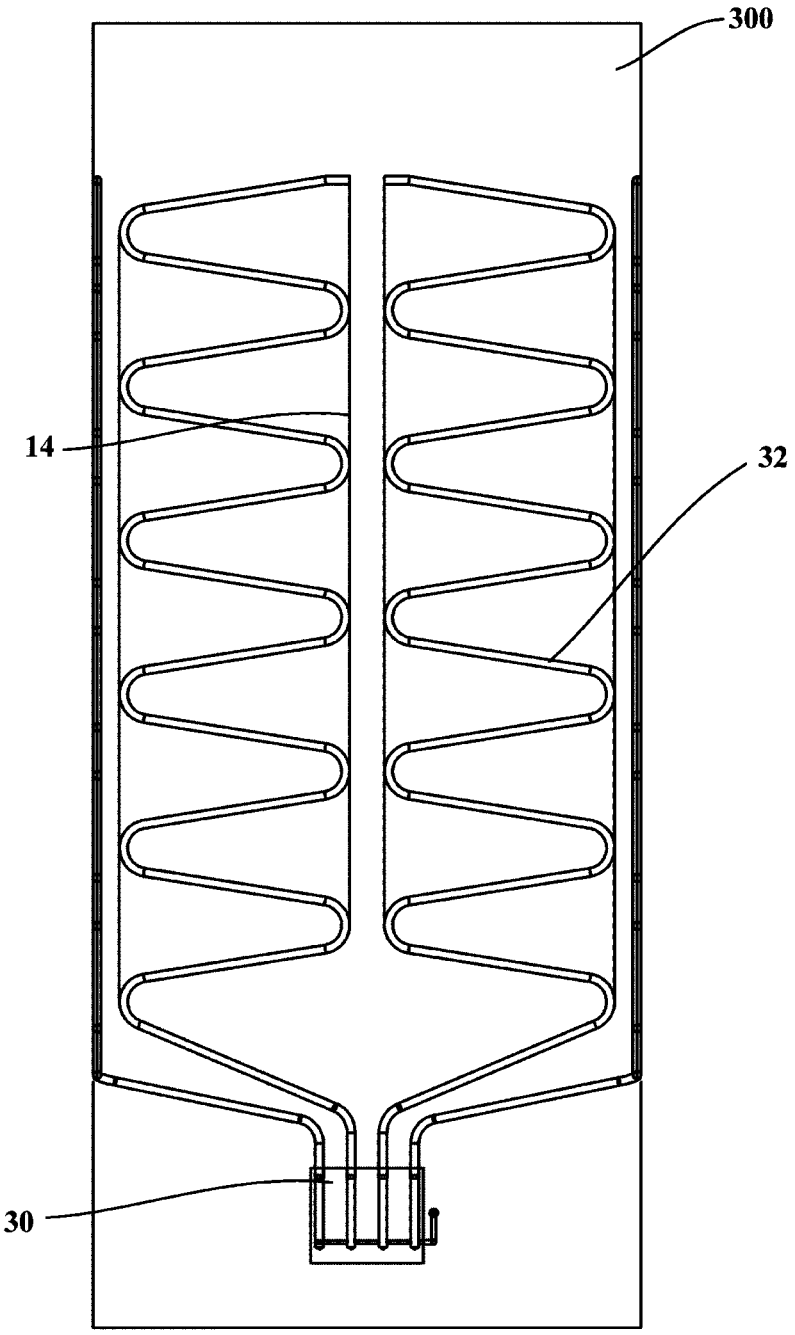
FIG. 8 is a schematic front view of a partial structure of a semiconductor refrigerator according to one embodiment of the present invention.

As shown in FIG. 8, the heat exchanging device may be a hot end heat exchanging device 30, and the refrigerant pipeline 32 of the hot end heat exchanging device 30 is a bent pipe 10 in any of the aforementioned embodiments and is mounted in such a way that the rear surface of the hot end heat exchanging part 31 is thermally connected to the hot end of the semiconductor cooler, and the condensation section of each of the refrigerant pipelines 32 is abutted against the inner surface of the housing 300 to diffuse the heat generated by the hot end to the surrounding environment. In order to expand the heat dissipation space of the hot end heat exchanging device 30, the semiconductor refrigerator may also be provided with a heat conducting device. The heat conducting device is provided vertically between the back of the housing 300 and the rear wall of the liner 100 as a heat bridge. The heat conducting device may include a first heat transfer block, a heat conductor, and a second heat transfer block. The first heat transfer block is thermally connected to the semiconductor cooler by means of direct abutting or other manners; the heat conductor has a pre-set heat transfer length in the vertical direction, with the first end thereof located at the upper portion being thermally connected to the first heat transfer block to transfer the heat of the hot end of the semiconductor cooler from the first end to the second end located at the lower portion; and the second heat transfer block is connected to the second end of the heat conductor and is thermally connected to the rear surface of the hot end heat exchanging part 31 by means of direct abutting or other manners.

At this point, those skilled in the art will recognize that, while numerous exemplary embodiments of the present invention have been shown and described in detail herein, many other variations or modifications that conform to the principles of the present invention may be determined or derived directly from the disclosure of the present invention without departing from the spirit and scope of the present invention. It therefore should be understood and determined that the scope of the present invention covers all such other modifications or modifications.

What is claimed is:

1. A bent pipe for a refrigerant to flow therein, the bent pipe comprising:

a plurality of bent portions;

a plurality of connecting pipe sections, each of the plurality of connecting pipe sections connecting two adjacent bent portions; and a retention member, which is successively fixed at different locations along the length thereof to the bent portions on the same side of the bent pipe, wherein:

a first end of the bent pipe is an open end which allows the refrigerant to flow into or flow out from the bent pipe, and a second end of the bent pipe is a closed end which prevents the refrigerant from flowing into or flowing out from the bent pipe.

2. The bent pipe according to claim 1, characterized in that each of the connecting pipe sections is a straight pipe.

3. The bent pipe according to claim 1, further comprising a further retention member, which is successively fixed at different locations along the length thereof to the bent portions on an other side of the bent pipe.

4. The bent pipe according to claim 3, characterized in that the retention member and the further retention member are arranged parallel to each other.

5. The bent pipe according to claim 1, characterized in that the retention member is a retention slat or a drawstring.

6. The bent pipe according to claim 1, characterized in that the retention member has an elastic modulus of 190 Gpa or more.

7. The bent pipe according to claim 1, characterized in that fixing the retention member successively at different locations along the length thereof to the bent portions on the same side of the bent pipe is implemented by welding the retention member successively at different locations along the length thereof to a top hump of each of the bent portions on the same side of the bent pipe.

8. The bent pipe according to claim 1, characterized in that pipe walls of the bent pipe that are in contact with the retention member are all fixed to the retention member.

9. A semiconductor refrigerator, comprising a liner, a semiconductor cooler, a heat exchanging device and a housing, the heat exchanging device being provided with a heat exchanging part which allows a refrigerant to flow therein and undergo phase-change heat exchange and a plurality of refrigerant pipelines with one end connecting to an inner cavity or pipeline of the heat exchanging part for transferring heat from the hot end of the semiconductor cooler to the housing, or transferring cold from the cold end of the semiconductor cooler to a storage compartment of the liner, characterized in that each of the refrigerant pipelines is a bent pipe according to claim 1.

* * * * *